US008272775B2

(12) United States Patent
Stalder

(10) Patent No.: US 8,272,775 B2
(45) Date of Patent: Sep. 25, 2012

(54) MIXING DRIER HAVING A SPHERICAL MIXING VESSEL

(75) Inventor: Hans Stalder, Siblingen (CH)

(73) Assignee: Mavag AG, Neunkirch (CH)

( * ) Notice: Subject to any disclaimer, the term of this patent is extended or adjusted under 35 U.S.C. 154(b) by 849 days.

(21) Appl. No.: 12/281,311

(22) PCT Filed: Mar. 1, 2007

(86) PCT No.: PCT/EP2007/001765

§ 371 (c)(1),
(2), (4) Date: Jan. 2, 2009

(87) PCT Pub. No.: WO2007/101603

PCT Pub. Date: Sep. 13, 2007

(65) Prior Publication Data

US 2009/0219781 A1 Sep. 3, 2009

(30) Foreign Application Priority Data

Mar. 3, 2006 (DE) ..... 20 2006 003 390

(51) Int. Cl.
*B01F 15/06* (2006.01)

(52) U.S. Cl. ..... 366/144

(58) Field of Classification Search ..... 366/144
See application file for complete search history.

(56) References Cited

U.S. PATENT DOCUMENTS

| | | | |
|---|---|---|---|
| 4,467,080 | A | 8/1984 | Brun et al. |
| 4,868,255 | A | 9/1989 | Chatelain et al. |
| 4,941,750 | A | 7/1990 | Bouchez et al. |
| 2001/0020657 | A1 | 9/2001 | Gloor |

FOREIGN PATENT DOCUMENTS

| | | | |
|---|---|---|---|
| DE | 20 2006 003390 | U1 | 7/2006 |
| DE | 20122686 | U1 | 8/2007 |
| EP | 1118381 | A2 | 7/2001 |
| JP | 58045725 | A | 3/1983 |

*Primary Examiner* — Yogendra Gupta
*Assistant Examiner* — John Robitaille
(74) *Attorney, Agent, or Firm* — Davis Wright Tremaine LLP; George C. Rondeau, Jr.

(57) ABSTRACT

A mixing drier in the form of a spherical mixer comprises an upper vessel shell and a lower vessel shell which can be closed together in a separation plane. A stirrer having a stirrer shaft and stirring elements is affixed to the upper vessel shell. The stirrer axis is inclined to the vertical. The separation plane is perpendicular to the stirrer axis. The stirring elements are located below the separation plane. A hinge is located in the separation plane and allows the vessel of the spherical mixer to be opened for cleaning.

8 Claims, 1 Drawing Sheet

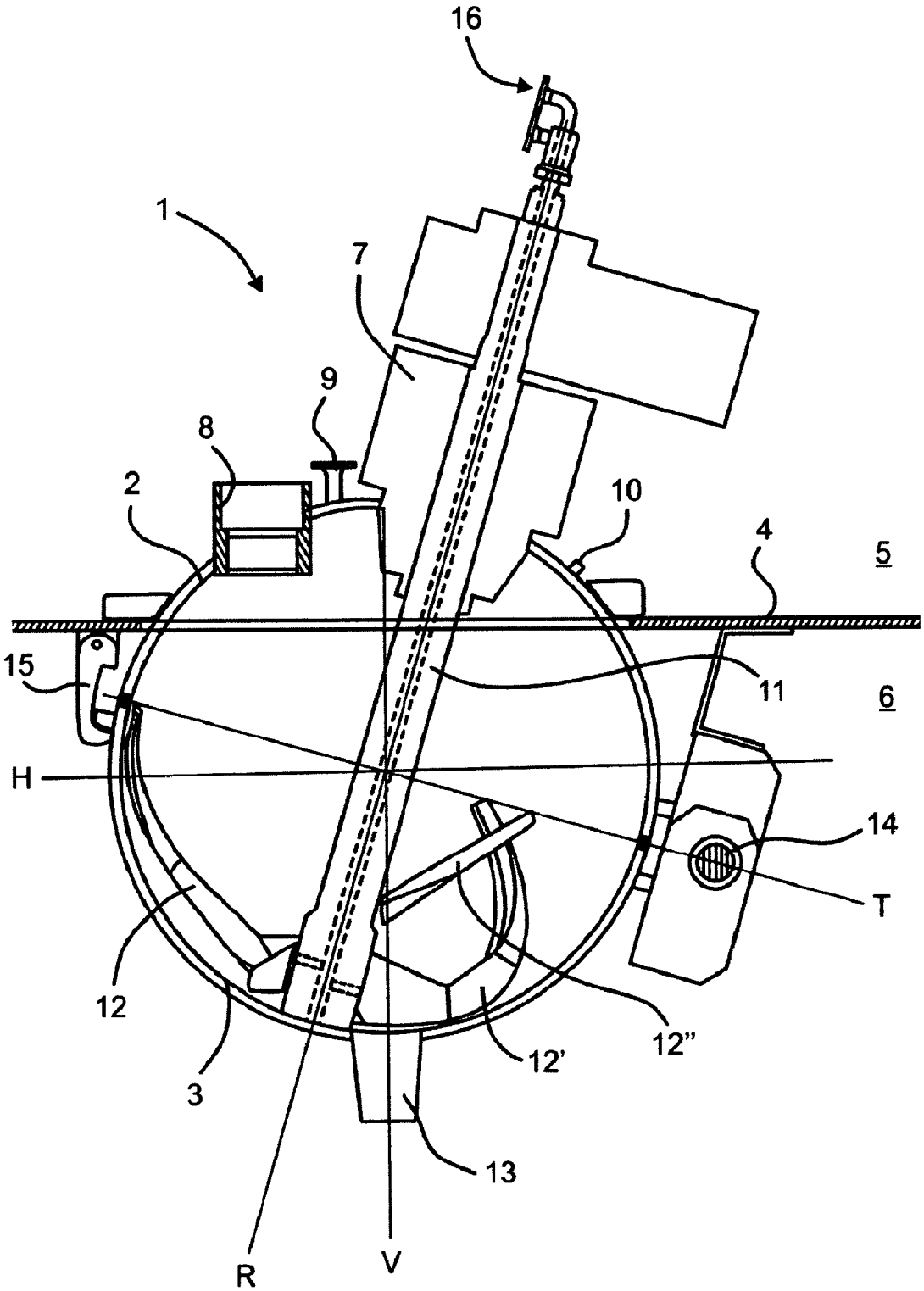
16
1
7
9
8
2
10
4
5
15
11
6
H
14
T
12
12"
12'
3
13
R
V

MIXING DRIER HAVING A SPHERICAL MIXING VESSEL

BACKGROUND OF THE INVENTION

1. Field of the Invention

The present invention concerns a mixing drier, and more specifically, a spherical mixer.

2. Description of the Related Art

Such mixing driers are used in the manufacture of pharmaceutical or chemical products such as medicaments or foodstuffs. Mixing driers are well known in the art and are described for example in EP-1 118 381. These devices comprise a container having the form of a body of revolution which consists of two separable half shells having an essentially horizontal separation plane. The upper half shell protrudes through the roof of the production chamber in order to be able to arrange the motor units for the stirrer or the chopper above the production chamber and spatially separated from this chamber. Removal of the processed charge is enabled via a charge outlet in the lower half shell. For cleaning, the lower half shell can be pivoted downwards by means of a hinge or can be vertically repositioned downwards and pivoted horizontally. In order to be able to arrange the charge outlet at the lowest point of the vessel, the shaft of the stirrer is inclined at about 20° in relation to the vertical axis.

Unfortunately, cleaning the upper half shell in such an assembly has proven to be laborious, that is to say that it cannot be cleaned thoroughly because when the vessel is opened, either the one or the other mixing element of the stirrer protrudes into the upper half shell.

SUMMARY OF THE INVENTION

It is therefore the aim of the present invention to provide a mixing drier having the charge outlet arranged in the lowest part of the vessel, thereby enabling the inner walls to be thoroughly cleaned in an easy manner.

This aim is achieved according to the invention by a mixing drier in the form of a spherical mixer having the features of claim 1, and in particular by a mixing drier whose stirrer axis is inclined in relation to the vertical axis, and whose separation plane lies between the two vessel shells orthogonally in relation to the stirrer axis, and whereby the mixing elements do not extend above the lower vessel shell.

Further preferred embodiments of the invention exhibit the features of the dependent claims.

Advantageously, the stirrer axis is inclined by 14° to 18° and preferably by 16° in relation to the vertical plane, and both vessel shells are pivotable in relation to each other by means of a hinge. It is particularly advantageous that the hinge is arranged within or above the separation plane and below the equatorial plane. Furthermore, in a preferred embodiment, the mixing elements are provided with conveying channels in which a hot fluid, for example water steam, may circulate and so heat the mixing elements.

The advantages of the mixing drier according to the invention are clearly apparent to the expert. On the one hand, the inclination of the stirrer allows for an improved mixing of the charge. At the same time, the orthogonal arrangement of the separation plane in relation to the stirrer axis, together with the appropriately dimensioned mixing elements, allow the upper vessel shell to be opened for complete exposure.

BRIEF DESCRIPTION OF THE DRAWING(S)

The invention shall be described in more detail with the aid of the FIGURE and an exemplary embodiment.

DETAILED DESCRIPTION OF THE INVENTION

FIG. 1 shows a cross-section through a mixing drier according to the invention.

The mixing drier shown in FIG. 1 in the form of a spherical drier 1 essentially comprises two vessel shells 2, 3. In the illustrated embodiment, the upper vessel shell 2 extends through a floor 4 which separates a machine room 5 from a production room 6, so as to completely prevent any contamination from the machine room 5 from entering the production room 6. A stirrer 7, a feed nozzle 8 as well as machine adapters 9, 10 are secured in the region of the upper vessel shell 2 facing the machine room. The stirrer 7, its stirrer shaft 11 and its stirring elements 12, 12', 12" extend into the lower vessel shell 3. An outlet valve 13 is arranged at the lowest part of the lower vessel shell 3. According to the invention, both the vessel shells 2, 3 are closable in a separation plane T, whereby this separation plane T lies essentially orthogonally in relation to the stirrer axis R, i.e. is inclined towards the horizontal equatorial plane H. This separation plane T can also be regarded as the delimitation surface of the envelope of movements of the stirring elements 12, 12', 12". It has proven to be particularly beneficial that the hinge 14 can be arranged in this separation plane T, because this allows the contour of the stirring elements 12, 12', 12" to follow the inner contour of the vessel more precisely, i.e. with the least tolerance. It is understood that a closure device 15 is arranged on the side facing the hinge 14.

In a further embodiment of the present spherical mixer 1 (spherical drier) the stirrer shaft 11 and the stirring elements 12, 12', 12" are provided with channels which allow a hot fluid 16 to circulate therein. Essential for the invention is that the stirring elements 12, 12', 12" do not extend above the lower vessel shell 3 or the separation plane T in order to ensure that when the vessel is opened, these stirring elements 12, 12', 12" completely expose the inner surface of the upper vessel shell 2.

In practice, the vessels of such spherical driers have a volume of between 400 to 4,000 liters. In particular, they are used in the production of granulates or powder-like substances for the pharmaceutical or foodstuff industry, which means that high standards of cleanliness are expected.

The invention claimed is:

1. Mixing drier in the form of a spherical mixer, whose vessel comprises an upper vessel shell and a lower vessel shell, said vessel shells being jointly closable in a separation plane, at the upper vessel shell there is arranged a stirrer having a stirrer shaft and having stirring elements, whose stirrer axis is inclined in relation to the vertical, wherein the separation plane lies orthogonally in relation to the stirrer axis and the stirring elements lie completely within the lower vessel shell, and do not extend into the upper vessel shell.

2. Mixing drier according to claim 1, wherein the stirrer axis is inclined by 16° towards the vertical.

3. Mixing drier according to claim 1, wherein the upper vessel shell extends through a horizontal floor which separates a production room from a machine room.

4. Mixing drier according to claim 1, wherein both vessel shells are pivotable against each other by means of a hinge.

5. Mixing drier according to claim 1, wherein the hinge lies in the separation plane.

6. Mixing drier according to claim 1, wherein the lower vessel shell is provided with an outlet valve in its lowest region.

7. Mixing drier according to claim 1, wherein the stirring elements follow the inner contours of the vessel.

8. Mixing drier according to claim 1, wherein the stirring elements have heating means.

* * * * *